US010290444B2

(12) United States Patent
Yang et al.

(10) Patent No.: US 10,290,444 B2
(45) Date of Patent: May 14, 2019

(54) FABRIC ABLE TO FORM ELECTRONIC ELEMENT

(75) Inventors: Changming Yang, Miaoli (TW); Tzulin Yang, Taipei (TW); Chingwen Yang, Taipei (TW); Hao Yang, Taipei (TW)

(73) Assignee: MING YOUNG BIOMEDICAL CORP., Miaoli (TW)

( * ) Notice: Subject to any disclaimer, the term of this patent is extended or adjusted under 35 U.S.C. 154(b) by 545 days.

(21) Appl. No.: 12/676,549

(22) PCT Filed: Sep. 3, 2008

(86) PCT No.: PCT/CN2008/001571
§ 371 (c)(1),
(2), (4) Date: Mar. 18, 2010

(87) PCT Pub. No.: WO2009/033362
PCT Pub. Date: Mar. 19, 2009

(65) Prior Publication Data

US 2010/0170704 A1 Jul. 8, 2010

(30) Foreign Application Priority Data

Sep. 4, 2007 (WO) ..... PCT/CN2007/002648

(51) Int. Cl.
*H01C 10/10* (2006.01)
*H01C 10/12* (2006.01)
*H01H 13/704* (2006.01)

(52) U.S. Cl.
CPC ..... *H01H 13/704* (2013.01); *H01C 10/10* (2013.01); *H01C 10/12* (2013.01);
(Continued)

(58) Field of Classification Search
CPC ..... H01H 2203/0085; H01H 2239/078; H01H 2209/042; H01H 13/704
(Continued)

(56) References Cited

U.S. PATENT DOCUMENTS 5,906,004 A * 5/1999 Lebby ..... A41D 31/00 139/425 R
6,333,736 B1 * 12/2001 Sandbach ..... 345/178
(Continued)

FOREIGN PATENT DOCUMENTS

JP H02-121458 10/1990
JP H04-077309 7/1992
(Continued)

OTHER PUBLICATIONS

Notice of Reasons for Rejection (Office Action) dated Oct. 2, 2012, from the Japan Patent Office in related Japanese Patent Application No. JP 2010-522169, with English translation (7 pages).
(Continued)

*Primary Examiner* — Timothy J Thompson
*Assistant Examiner* — Rhadames Alonzo Miller
(74) *Attorney, Agent, or Firm* — Chun-Ming Shih; HDLS IPR Services

(57) ABSTRACT

A cloth material that can form an electronic component includes a cloth material layer, which includes at least one crevice; and a conductive area included in the cloth material layer, wherein a shape of the crevice and a shape of the conductive area change with an outside force. A cloth material that can form an electronic component includes two cloth material layers stacked to form a crevice therebetween; and a conductive area located on the two cloth material layers spanning from one side of the crevice to the other side of the crevice, wherein a shape of the crevice and the conductive area changes with an outside force.

18 Claims, 10 Drawing Sheets

(52) U.S. Cl.
CPC ..... *H01H 2203/0085* (2013.01); *H01H 2209/042* (2013.01); *H01H 2239/078* (2013.01)

(58) Field of Classification Search
USPC ..... 174/254
See application file for complete search history.

(56) References Cited

U.S. PATENT DOCUMENTS

| | | | | |
|---|---|---|---|---|
| 6,452,479 | B1 * | 9/2002 | Sandbach | 338/208 |
| 7,378,608 | B2 * | 5/2008 | Marmaropoulos et al. | 200/511 |
| 2002/0121146 | A1 * | 9/2002 | Manaresi | B63H 9/06 73/862.68 |
| 2003/0037966 | A1 * | 2/2003 | Sandbach | G01L 1/205 178/18.05 |
| 2006/0071751 | A1 * | 4/2006 | Wagner et al. | 338/47 |
| 2006/0246744 | A1 | 11/2006 | Marmaropoulos et al. | |
| 2006/0251854 | A1 | 11/2006 | Marmaropoulos et al. | |

FOREIGN PATENT DOCUMENTS

| | | | |
|---|---|---|---|
| JP | 3070358 | U | 5/2000 |
| JP | 2001-207318 | A | 8/2001 |
| JP | 2006-527460 | A | 11/2006 |
| JP | 2006-529007 | A | 12/2006 |
| JP | 2007-185480 | A | 7/2007 |
| WO | 2004-100691 | A1 | 11/2004 |
| WO | 2004-109730 | A1 | 12/2004 |

OTHER PUBLICATIONS

Espacenet English abstract for JP 2007-185480 published Jul. 26, 2007 (2 pages).

Official Action (Decision of Rejection) dated Nov. 14, 2013, by the Japan Patent Office, in related Japanese Patent Application No. 2010-522169. (3 pages).

Notice of Reasons for Rejection (Office Action) dated Feb. 3, 2015, by the Japan Patent Office in corresponding Japanese Patent Application No. JP 2010-522169, with Google machine-translation (4 pages).

* cited by examiner

FABRIC ABLE TO FORM ELECTRONIC ELEMENT

CROSS REFERENCE TO RELATED APPLICATIONS

This is a national stage application of PCT/CN2008/001571, filed on Sep. 3, 2008, which claims priority of PCT/CN2007/002648, filed on Sep. 4, 2007. The disclosures of these prior filed applications are incorporated herein by reference in their entirety.

FIELD OF THE INVENTION

This invention relates to cloth materials that can be used to form electronic components, especially materials that contain crevices (slits), wherein conductive areas are formed on both sides of a crevice.

This application is based on PCT application No. PCT/CN2007/002648, filed on Sep. 4, 2007, and claims the priority of this prior filed PCT application. This prior filed PCT application is incorporated by reference in its entirety.

BACKGROUND

Currently, there are many technologies incorporating conductive materials into cloth or leather materials to create electrical circuits or to make electronic components. Included are technologies that incorporate conductive materials into cloth materials to create electric switches, for example, the bendable switch apparatus, as disclosed in U.S. Pat. No. 7,145,432, makes use of a textile material arranged in triple layers to form an electric switch. Another example, as disclosed in U.S. Pat. No. 6,642,467 (China Patent No. CN 1252762), is an electric switch that utilizes an upper and a lower layer of a conductive material sandwiching an elastic material. This device can be a pressure or strain sensor, but a pressure-sensitive component has to be added therein. Based on the amount of pressure applied, this pressure-sensitive component will produce a change in electrical characteristic. The layered textile materials for use in the afore-mentioned electric switches are common and numerous. However, these often involve multiple components, making the manufacturing process somewhat complicated.

Furthermore, U.S. Pat. No. 6,596,955 discloses fixing a conductive material into a zipper. This approach limits its use to clothing articles that use a zipper. Also, it can't be repaired by the user himself. Another example disclosed in China Patent No. CN1666308, is an electrical switch made of an upper and lower parts. However, because it can't be incorporated into a cloth material, the manufacturing process is somewhat complicated.

Also, some use such materials in a signal or electric current transmitting device, as disclosed in U.S. Pat. No. 7,154,071. But again, as in the above examples, it has disadvantages of requiring a complicated manufacturing process. U.S. Pat. Nos. 4,237,886 and 6,970,731 disclose a snap-on button that easily detaches with prolonged use. U.S. Pat. No. 6,210,771 discloses a 2-part structure that can be used in a switch array. However, such an array not only easily produce a false signal, but its function is also easily affected by wet cloth caused by sweat or rain, or may give the user electric shocks. Besides, this invention can only measure pressure, but not strain.

As disclosed in U.S. Pat. No. 7,210,939, a button-hole interconnect that is used as a conductor includes an opening and the button interconnect device. These two has to be operated manually by the user to be able to connect to the power source or an electronic equipment, and once electrically connected, it cannot be disconnected. Therefore, in terms of environmental protection and energy-savings, it is not ideal because it cannot automatically change its state of being conductive or non-conductive based on changes in an outside force, and it also can't distinguish different extent of conductivity once it is connected.

From these examples, we can see that presently available cloth materials that can form electronic components are inconvenient to use and disadvantageous with regard to structure and practical use. Therefore, there is a need for further improvement. To solve the above-mentioned problems, manufacturers have devoted a lot of energy to find a solution. However, for a long time, a suitable design has not been developed, and the ordinary products do not posses the appropriate designs that can solve the above problems. This is clearly an urgent problem. Therefore, how to design a new structural type of cloth materials that can be used to form electronic components is an important research topic at present, and improvement in this area is also a goal of the industry.

In view of the disadvantages of the presently available types of cloth materials for making electronic components, the present inventor, based on his practical experience and professional knowledge from years of devotion to the design and manufacturing of these types of products, coupled with theoretical applications and vigorous research and innovation, set out to design and develop a new type of cloth materials that can be used to form electronic components to improve on the presently available types of cloth materials so that such materials will have more practical uses. After continuous research, design, trials, and improvement of prototypes, the inventor has finally come up with this invention with true practical values.

SUMMARY OF THE INVENTION

An objective of this invention is to overcome the disadvantages of presently available cloth material that can form an electronic component and provide a new type of cloth materials that can be used to form electronic components. The technical problem to overcome is how to incorporate a conductive area into a single piece of cloth material to simplify the manufacturing process.

Another objective of this invention is to provide a new type of cloth materials that can be used to form electronic components, in which the technical problem to overcome is to design a mechanism that allows power to be automatically cut off when a product of the invention gets wet.

Another objective of this invention is to provide a new type of cloth materials that can be used to form electronic components, in which the technical problem to overcome is to design a mechanism that allows products of this invention to be used as strain gauges or pressure gauges.

Another objective of this invention is to provide a new type of cloth materials that can be used to form electronic components, in which the technical problem to overcome is to design a mechanism that allows products of this invention to be used as electrodes.

Objectives of the invention and methods for overcoming the technical problems are achieved by the following technical means. Embodiments of the invention provide a new type of cloth materials that can be used to form electronic components. A cloth material of the invention includes: one cloth material layer that is elastic; the cloth material layer includes at least one crevice (or slit) and a conductive area in the cloth material layer; the shapes of the crevice and the conductive area can change with an outside force applied on the cloth material layer.

Objectives of the invention and methods for overcoming the technical problems may also be achieved by utilizing the following technical means:

In an above-mentioned cloth material that can be used to form an electronic component, the conductive area includes at least one first conductive region; the at least one first conductive region extends from one side of the crevice to the other side.

In an above-mentioned cloth material that can be used to form an electronic component, the conductive area includes at least one first conductive region and at least one second conductive region, which are separately located on both sides of the crevice.

An above-mentioned cloth material that can be used to form an electronic component may also include a control circuit that is electrically connected to the conductive area.

An above-mentioned cloth material that can be used to form an electronic component may also include an output device that is electrically connected to the control circuit.

An above-mentioned cloth material that can be used to form an electronic component may also include a conductive reference area on the cloth material layer and electrically connected to the control circuit.

This invention, as compared with presently-available technology, has clear advantages and beneficial effects. From the above description, to achieve the above-mentioned objectives, the present invention provides a type of cloth materials that can be used to form electronic components. A cloth material of the invention may include a cloth material layer, a first conductive area, and two conductive wires. The cloth material layer contains one crevice. The first conductive area may be formed in the cloth material layer, and may extend from one side of the crevice to the other side. Alternatively, both sides of the crevice each may include one conductive area. Here, the signals produced may be digital signals. The noise included in the signals may be processed with a Schmitt trigger.

Based on the Above-Mentioned, Cloth Materials that can be Used to Form Electronic Components May have the Following Advantages and Beneficial Effects:

1. A cloth material that can be used to form an electronic component can incorporate a conductive area into a piece of cloth material and simplify the manufacturing process.
2. A cloth material that can be used to form an electronic component can automatically cut off its own power when it gets wet.
3. A cloth material that can be used to form an electronic component can be used as a strain gauge or a pressure gauge.
4. A cloth material that can be used to form an electronic component can be used as an electrode.

Summarizing the above, this invention provides many advantages and practical values. In terms of structure and functionality, it has significant improvement. In terms of technology, it presents a clear advancement and provides convenience and practicality. When compared with present-day types of cloth materials that can be used to form an electronic component, cloth materials of the invention show further breakthrough, rendering more practical to use. Thus, the present invention represents a novel, advanced and practical new design.

The above description is only an overview of the technical means of embodiments of the invention. In order to provide a better understanding of the technological means and to help users practice this invention, and to make the objectives and advantages of the present invention easier to understand, preferred embodiments, with accompanying drawings, are described in more detail in the following:

REFERENCE NUMERALS USED IN THE DRAWINGS

Figure 1:
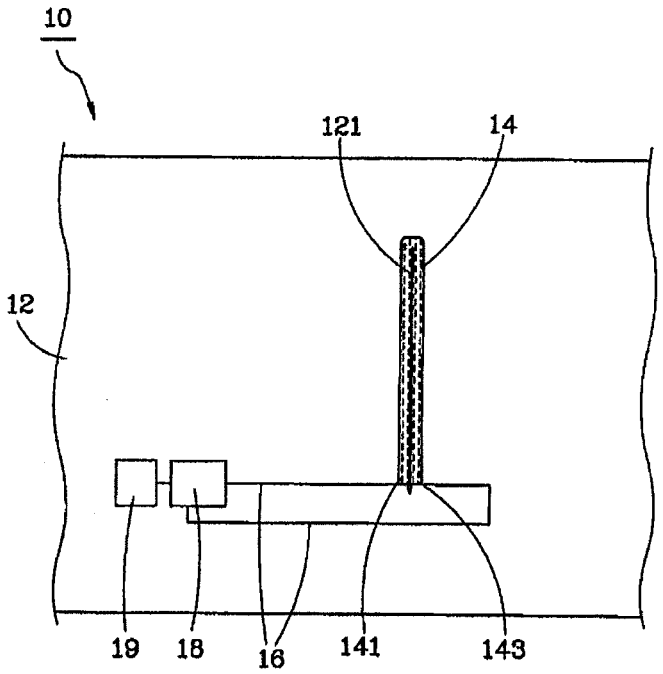
FIG. 1 shows a cloth material in accordance with one embodiment of the invention.

10 cloth material that can be used to form an electronic component;

12 Cloth material layer, 1121 Crevice, 14 First conductive area;

141 First end, 143 Second end, 16 Conducting wire;
18 Control circuit, 19 Output device;
10*a* cloth material that can be used to form an electronic component;
12*a* Cloth material layer, 121*a* Crevice, 14*a* First conductive area;
15*a* Reference area, 16*a* Conducting wire, 18*a* Control circuit;
19*a* Output device;
20 cloth material that can be used to form an electronic component, D elastic direction;
22 Cloth material layer, 221 Crevice, 223 Reference area;
23 First conductive area, 24 Second conductive area;
25 Cushion pad, 251 Perforation, 26 Conducting wire, 27 User's skin;
20*a* cloth material that can be used to form an electronic component;
22*a* Cloth material layer, 221*a* Crevice, 23*a* First conductive area;
24*a* Second conductive area, 26*a* Conducting wire;
28*a* Control circuit, 29*a* Output device;
20*b* cloth material that can be used to form an electronic component;
22*b* Cloth material layer, 221*b* Crevice, 223*b* Protrusion;
23*b* First conductive area, 24*b* Second conductive area;
30 cloth material that can be used to form an electronic component;
32 Cloth material layer, 321 Crevice, 323 Outer side;
33 First conductive area, 34 Second conductive area, 35 Cushion pad;
351 Perforation, 36 Conducting wire, 37 User's finger;
38 Control circuit, 39 Output device;
40 cloth material that can be used to form an electronic component;
42 Cloth material layer, 421 Crevice, 43 First conductive area;
44 Second conductive area, 46 Conducting wire;
48 Control circuit, 49 Output device;
50 cloth material that can be used to form an electronic component;
52 Cloth material layer, 521 Crevice, 53 First conductive area;
54 Second conductive area, 56 Conducting wire;
58 Control circuit, 59 Output device;
60 cloth material that can be used to form an electronic component;
62 Cloth material layer, 621 Crevice, 63 First conductive area;
64 Second conductive area;
70 cloth material that can be used to form an electronic component;
72 Cloth material layer, 721 Crevice, 73 First conductive area;
74 Second conductible area, 75 Third conductible area, 76 Conducting wire;
80 cloth material that can be used to form an electronic component;
81 Base cloth material, 82 Cloth material layer, 83 First conductive area;
84 Second conductive area, 85 Cushion pad, 87 User's skin;
89 Control circuit;
90 cloth material that can be used to form an electronic component;
91 Cloth material layer, 911 Crevice, 92 First conductive area;
93*a* Second conductive area, 93*b* Second conductive area;
130 cloth material that can be used to form an electronic component;
131 Cloth material layer, 1311 First conductive area, 132 Crevice;
132*a*, 132*b*, 132*c* Second conductive area;
140 cloth material that can be used to form an electronic component;
141 Cloth material layer, 1411 First conductive area, 142 Crevice;
142*a*, 142*b*, 142*c* Second conductive area;
110 cloth material that can be used to form an electronic component;
111 Cloth material layers, 111*a* Upper layer, 111*b* Lower layer;
1121 Crevice, 113 First conductive area;
114*a* Second conductive area, 114*b* Second conductive area;
114*c* Second conductive area;
120 cloth material that can be used to form an electronic component;
121 Cloth material layers, 122 Crevice,
123*a*, 123*b*, 123*c* First conductive area, 124 Second conductive area;
150 cloth material that can be used to form an electronic component;
151 Cloth material layers, 151*a* Upper layer, 151*b* Lower layer;
1521 Crevice, 153 First conductive area;
154*a*, 154*b*, 154*c* Second conductive area;

DETAILED DESCRIPTION

In order to further explain this invention to attain the goals of the technological means and effectiveness, the following description uses drawings coupled with preferred examples to illustrate specific modes of application, structure, special features and effectiveness of cloth materials that can be used to form electronic components, in accordance with embodiments of the invention:

With regard to the above explanation of this invention and other technological contents, special features and effectiveness, it will become clear from the following description using drawings and preferred embodiments. Through specific modes of application, one can further understand this invention in order to achieve the goals with the technological means and effectiveness. However, the drawings provided are for reference and illustration only, and are not meant to limit the scope of this invention.

Referring to FIG. 1, which shows a first preferred embodiment of the invention, a cloth material 10 that can be used to form an electronic component includes one cloth material layer 12, a conductive area, two conductive wires 16, a control circuit 18, and an output device 19.

The above-mentioned cloth material layer 12 may be a piece of woven cloth that includes elastic fibers and contains a crevice 1121. The cloth material layer 12 can include other elastic material, such as rubber, foam-based material, spongy material, spring-liked material, cotton, spandex, lycra, synthetic rubber (SBR, Styrene Butadiene Rubber) and sponge-based material in the manufacturing process in order to increase its elasticity.

The above-mentioned conductive area includes a first conductive region 14, which may be formed on the cloth material layer 12 and extends from one side of the crevice 1121 to the other side. The first conductive region 14 may form around the rim of the crevice 1121 of the cloth material layer 12. The first conductive region 14 can be formed in the following manners (but not limited to it):

1. By means of a textile process, weaving non-conductive fibers and conductive fibers together, either by knitting, weaving, tatting, embroidering or other appropriate means;
2. By embedding, sticking or sewing a conductive metallic plate in the cloth material layer 12;
3. By sewing fine, conductive wires into the cloth material layer 12;
4. By applying a conductive material with adhesive substance over the cloth material layer 12.
5. By sticking or sewing a conductive cloth material over the cloth material layer 12.

The above-mentioned non-conductive textile fibers may be, but not limited to, cotton, hemp or nylon, while the conductive fibers may be polymer conductive fibers or conductive metallic fibers, or weaving a stainless steel fiber and a non-conductive fiber together, or applying a conductive substance over a non-conductive fiber. The percentage of the so-called conductive fibers in the first conductive region 14 can range from 1% to 100%. In some examples, the first conductive region 14 may be formed by sewing fine conductive wires around the rim of the crevice 12. The first conductive region 14 may form a U shape, and contains a first end 141 and a second end 143. This type of cloth materials that can be used to form electronic components can be used as an accessory which is sewn into clothing, bed sheets, or other leather materials such as a car seat or a steering wheel cover.

The two conductive wires 16 are fixed to the cloth material layer 12, and are connected separately to the first end 141 and the second end 143 of the first conductive region 14.

The control circuit 18 may be set on the cloth material layer 12. It can be a printed circuit board or an IC board. The control circuit 18 is connected separately to the two conductive wires 16, causing the first conductive region 14, the two conductive wires 16 and the control circuit 18 to form a loop together. The control circuit 18 may be internally equipped with a resistor, which is used to measure the resistance in the electrical loop. The control circuit 18 may be equipped with a power source.

The above-mentioned output device 19 is electrically connected to the control circuit 18, and can be an electric horn.

Figure 2:
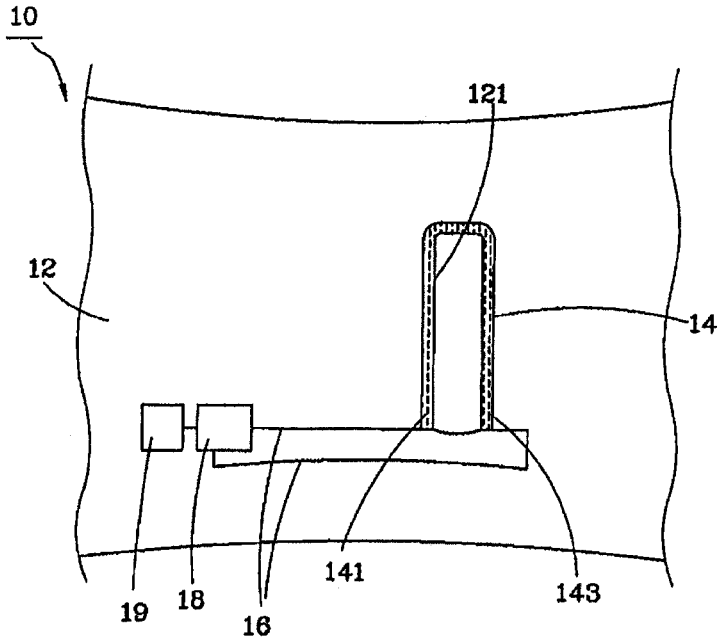
FIG. 2 shows the condition of the cloth material layer of the embodiment shown in FIG. 1, as it is being pulled.

Based on the above structure, when a cloth material that can be used to form an electronic component 10 is not experiencing any form of outside pressure, the crevice 1121 of the cloth material layer 12 is closed, as shown in FIG. 1. During this time, the first end 141 and the second end 143 of the first conductive region 14 are adjacent to each other. However, when the user pulls or drags from two sides of the cloth material 10, (please refer to FIG. 2) the crevice 1121 of the cloth material layer 12 will open. At this moment, the resistance measured by the control circuit 18 will increase proportionately as the distance between the first and the second ends 141, 143 of the first conductive region 14 increases. Based on this, the control circuit 18 will detect a change in resistance and command the output device 19 to emit a sound. This cloth material 10 can be used as a position-change sensor, speedometer, or an acceleration sensor. For example, if we put this cloth material into a user's shoe, we will be able to analyze the user's gait and detect a fall. It can also be used to detect an increase or decrease in the user's chest or abdominal girth as his age advances.

The cloth material layer 12 may be highly elastic due to its component of elastic fibers. Therefore, when the user exerts only a minimal force in pulling or dragging from two sides, the crevice 1121 of the cloth material layer 12 will remain closed. The force that the user exerts needs to exceed a set threshold value in order to open up the crevice 1121. This threshold value will depend upon the ratio of the elastic material used in the cloth material layer 12. Moreover, the cloth material layer 12 can be made of non-woven cloth, plastic cloth, leather material, or other less elastic material.

Each of the two sides of the crevice 1121 can also be provided with different materials. For example, one side of the crevice 1121 may be made of a non-elastic material, while the other side of the crevice 1121 may be made of an elastic material. The result is that the force needed to pull and drag the crevice 1121 open would be twice that needed to open the crevice 1121 made of similar elastic material on both sides, in order to produce the same result.

Furthermore, during the design, the crevice 1121 of a cloth material layer 12 may be made wider so that it will tend to remain open even before any outside force is applied. When the user pushes the cloth material layer 12 around the crevice 1121 from both sides, the crevice 1121 will close, thereby effecting a change in the resistance of the electrical loop.

Furthermore, a cloth material that can be used to form an electronic component 10 can also be used as a switch. Here, the ON-OFF function of the switch will be based on the high and low values of the resistance in the electrical loop. And the setting of the switch is determined by the magnitude of the outside force. When the outside force is larger than a certain value, the resistance is simultaneously higher than a set value. The result may be either a short circuit or an open circuit.

Since a cloth material that can be used to form an electronic component 10 is formed on one single piece of a cloth material, the manufacturing process will be a lot easier than if two pieces of cloth material were used.

Furthermore, during the actual manufacturing process, the manufacturer can choose to use cloth materials of differing elasticities, change the size and shape of the crevice 1121, or change the width of the first conductive region 14, or the overlapping of the first conductive region in between the crevices, or the separation of the first conductive region in between the crevice, in order to change the sensitivity and the electric resistance of the cloth material 10. Again, during actual use, a cloth material 10 can be made into a piece of clothing for the user to put on. Based on the different body movements of the user, thereby pulling and dragging the cloth material 10, the output device 19 may emit a sound. Based on this, the cloth material that can be used to form an electronic component 10 can be used by the deaf or mute as a means of communication, or by the user as a signal-producing device. Besides these, a cloth material that can be used to form an electronic component 10 can also be used to detect a change in the user's position. As a position-change posture detecting device, it can help to determine if the user has fallen down, thereby alerting a remote care-taker to come and provide assistance. Furthermore, the output device 19 may be an LED indicator lamp which can light up when there is a change in the resistance in the electrical loop.

Figure 3:
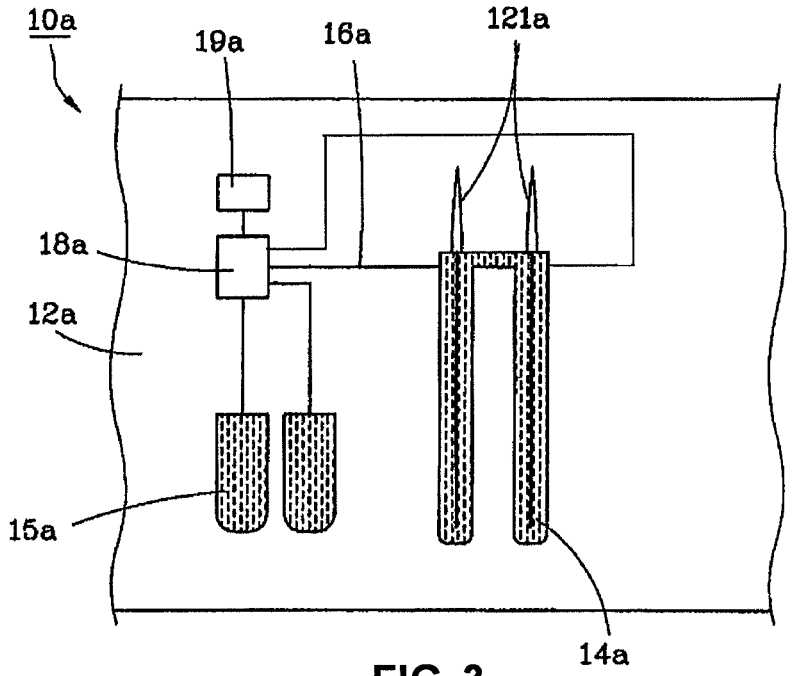
FIG. 3 shows another cloth material in accordance with a second embodiment of the invention.
Figure 4:
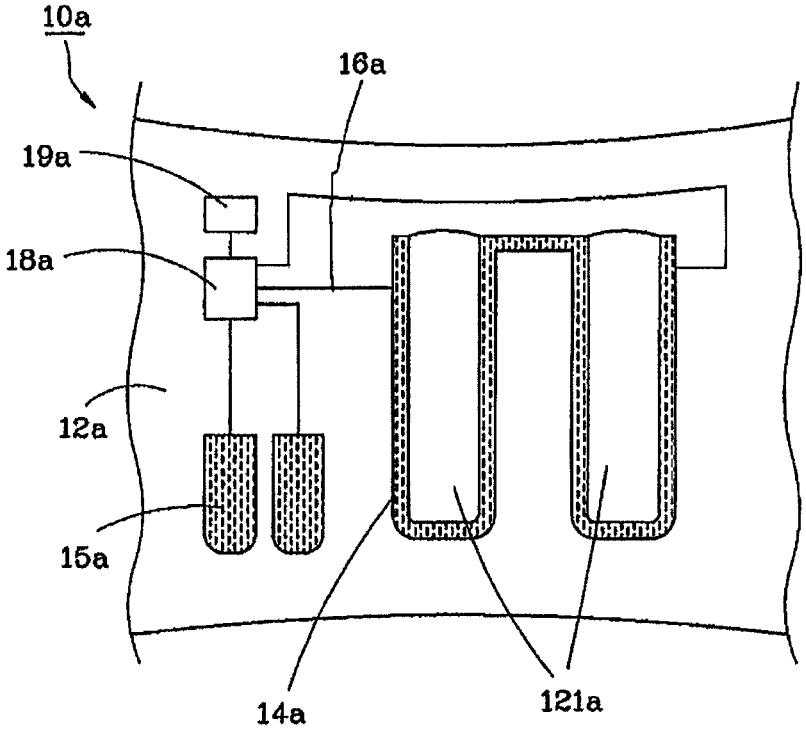
FIG. 4 shows the condition of the cloth material layer in the cloth material of the second embodiment shown in FIG. 3, as it is being pulled.

Based on the concept of this invention, a cloth material that can be used to form an electronic component 10, in reality, can have different changes varieties. (please refer to FIG. 3 and FIG. 4). A cloth material that can be used to form an electronic component 10*a* in a second exemplary embodiment of the invention is almost the same as that provided in the previous example. The only difference is that the number of the crevices 121*a* in the cloth material layer 12*a*, and the number of the first conductive regions 14*a* are both two. The two first conductive regions 14*a* are individually formed around the rim of the two crevices 12*a*. The two first conductive regions 14*a* are electrically interconnected, and form a W shape.

In addition, a cloth material that can be used to form an electronic component 10*a* may also include two conductive reference areas 15*a* that is formed in the cloth material layer 12*a* or in other cloth material layers. The two conductive reference areas 15*a* may be separated from the first conductive region 14*a* by a space. The reference areas 15*a* are electrically connected to a control circuit 18*a*. When the cloth material 10*a* is in normal use, the two reference areas 15*a* and the first conductive region 14*a* are not in contact with each other, therefore not forming an electrical loop. However, when the two reference areas 15*a* form an electrical loop, or any one of the two reference areas 15*a* forms an electrical loop with any one of the first conductive regions 14*a*, as in the case when the cloth material layer 12*a* gets wet, the control circuit 18*a* will automatically cut off power to prevent a short circuit, thereby preventing the user from accidental electrocution. Therefore, the control circuit 18*a* can be also used as a moisture sensor.

In addition, the number of the crevices 121*a* in the cloth material layer 12*a* can be more than three, so the whole structure forms a wave-shape. This can also achieve a similar effect.

Figure 5:
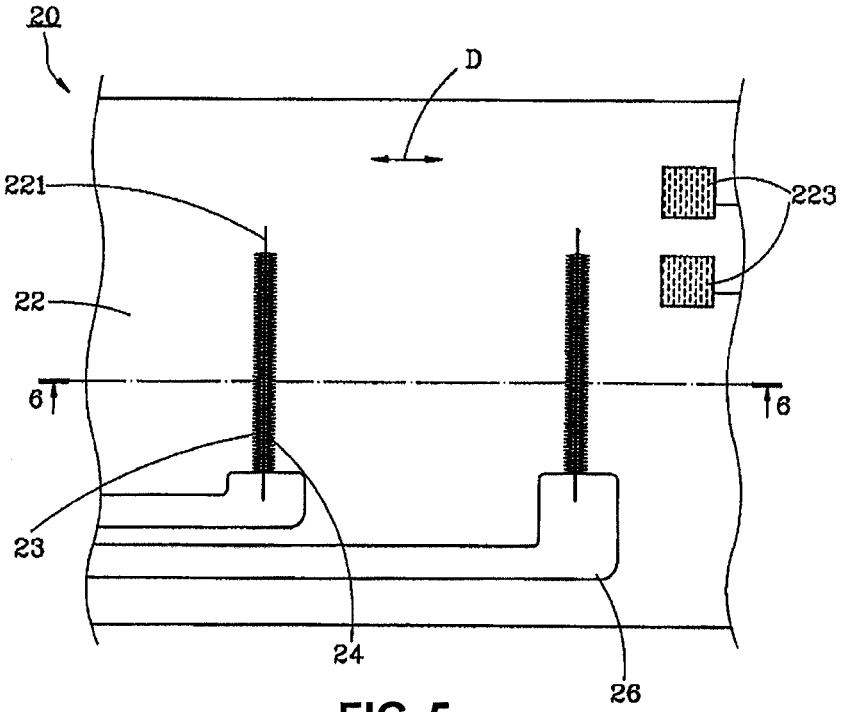
FIG. 5 shows another cloth material in accordance with a third embodiment of the invention.
Figure 6:
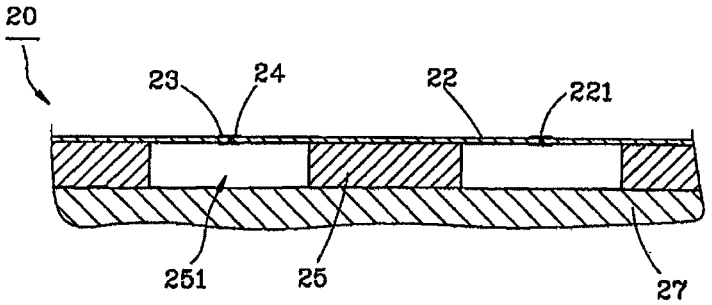
FIG. 6 shows a sectional view along the direction 6-6 of the cloth material of the third embodiment shown in FIG. 5.

Please refer to FIG. 5 and FIG. 6, a cloth material that can be used to form an electronic component 20 according to another example of the invention may contain a cloth material layer 22, conductive areas, two reference areas 223, one cushion pad 25, several conducting wires 26, one control circuit (not shown in drawing) and one output device (not shown in drawing).

The cloth material layer 22 has two crevices 221, which are elastic. The cloth material layer 22 also has an elastic direction D. If the applied force is the same, when the user pulls the cloth material layer 22 along the direction of the elastic direction D, the cloth material layer 22 will have a larger change than if it were pulled along another direction. The direction of extension of the crevice 221 in the cloth material layer 22 is perpendicular to the elastic direction D.

The above-mentioned conductive areas contain a first conductive region 23 and a second conductive region 24, which form on the cloth material layer 22, and are separately located along both sides of the rim of the crevice 221. The reference areas 223 are located on the cloth material layer 22. When outside force is not applied, the first and second conductive regions 23, 24 are in contact with each other, and the resistance is zero. When an outside force is applied, the two conductive regions 23, 24 are separated and the resistance may approach infinitely large. Therefore, this may be a digital signal, rather than an analog signal. The cloth material that can be used to form an electronic component 20 is a simple broken circuit/short circuit switch (ON/OFF switch), and this is not as sensitive as the traditional accelerometers or gyroscopes, and, therefore, this material can be wearable and washable. The cloth material 20 can be used as a gait analyzer and a long-term monitor of position changes. Wearing the cloth material 20, the data on different body positions can be sent in the form of broken circuit/short circuit signals (ON/OFF) as 0 or 1, either through a wired connection or wirelessly, to a nursing facility. Therefore, the nursing facility will know the present condition of the user, for example, whether the user has fallen down, is having a seizure, or has a stroke, or any abnormal change. At the same time, the 0 and 1 signals can be transformed into 3D animation. For example, a stroke patient can use the gait analyzer and position change sensor signals to help with rehabilitation. At the same time, medical personnel can monitor his progress. For normal persons, these signals can be used as an exercise guide. For example, in Tai Chi (Chinese Kong Fu), where emphasis is on the harmony of the boxing movements and the respiration, a lay people may find it difficult to understand the coordination. However, using these respiration and posture sensors, one can show in 3D animation the changes in respiration, making it easier for the beginner to understand.

The cushion pad 25 may be attached on the inner surface of the cloth material layer 22 and has two perforations 251. The locations of these two perforations 251 correspond to the crevices 221 of the cloth material layer 22. The cushion pad 25 may directly contact user's skin 27. The cushion pad 25 may be embedded or sewn into the cloth material layer 22. The cushion pad 25 may be made of a metallic material or a non-metallic material, such as a woven material, non-woven material, or a leather material.

In the above example, the control circuit is set on the cloth material layer 22, and is electrically connected, via the conductive wires 26, to the reference area 223 and the first and second conductive regions 23, 24. The output device may be attached to the cloth material layer 22, and is electrically connected to the control circuit.

Figure 7:
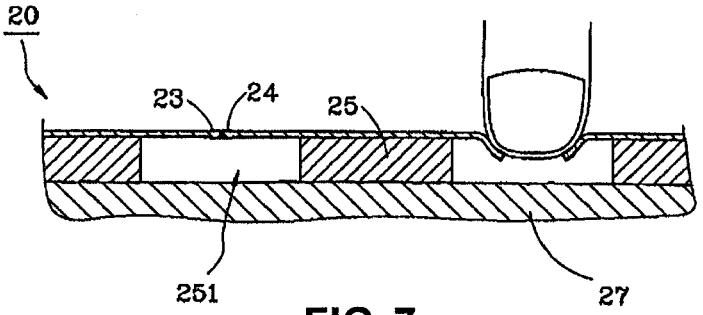
FIG. 7 shows the condition of the cloth material layer of the cloth material shown in FIG. 6, as it is being pressed.

Based on these, when an user inserts his finger into the crevice 221 of the cloth material layer 22 (as shown in FIG. 7), the capacitance formed in the first conductive regions 23 and the second conductive regions 24 will change proportionally as the distance between the first and second conductive regions 23, 24 changes. The control circuit can monitor this change in capacitance. Based on this, the control circuit may issue a command to the output control to emit a signal. In addition, the user can feel the opening and closing of the crevice using his finger, and be certain that the cloth material that can be used to form an electronic component 20 has been activated. The cushion pad 25 is used to elevate the cloth material layer 22, allowing the user to insert his finger into the crevice 221 with ease.

Furthermore, during use, the cloth material that can be used to form an electronic component 20 can result in a change in the electric resistance when the cloth material layer 22 is pulled. When the cloth material 20 is made into a tight-fitting garment and worn by a user, it can detect a change in the electric resistance by analyzing the breathing motion of the user. Therefore, this cloth material 20 can be used as a breathing monitoring device. Furthermore, when the cloth material 20 is set on top of a bed or a chair, the pressure that is made to bear on the cloth material layer in different locations will cause changes in the electric resistance, allowing it to fully reflect the changes in sleeping or sitting positions/postures. At the same time, this material may also be used as a swallow action sensor.

Furthermore, because the change in the electric resistance is related to the magnitude of pressure or strain that is made to bear on the cloth material layer 22, the cloth material 20 may be used as a variable resistor, a pressure gauge, a strain gauge, or a switch. And the settings of this switch may be determined by the magnitude of force that is applied. When this force is higher than a predetermined value, then it can be set as on or off.

Figure 8:
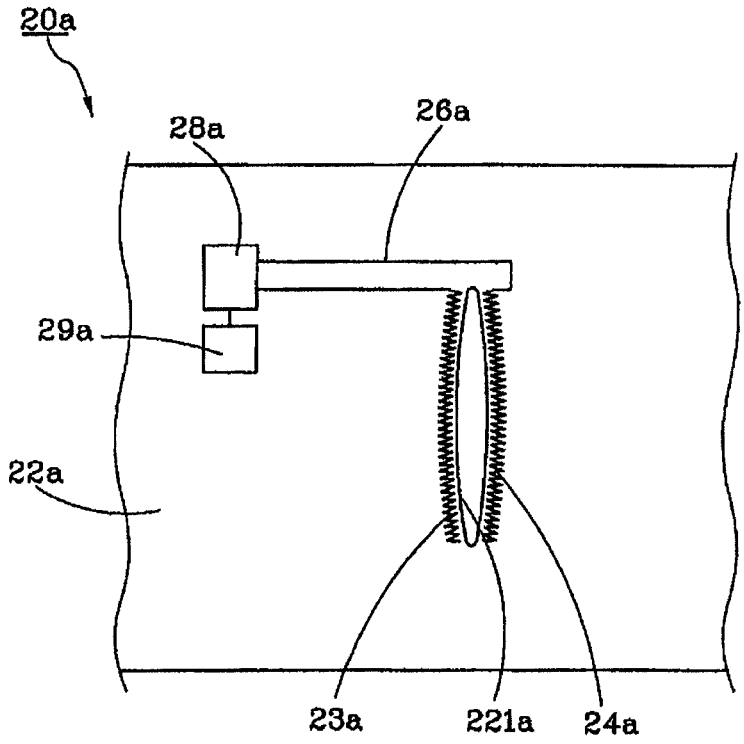
FIG. 8 shows another cloth material in accordance with a fourth embodiment of the invention.

Referring to FIG. 8, which shows a cloth material that can be used to form an electronic component 20*a* in another example, which is almost the same as the previous example.

The only difference is that the first conductive region 23*a* and the second conductive region 24*a* are located on both sides of the crevice 221*a* of the cloth material layer 22*a*, and are separated by a fixed distance from the rim of the crevice 221*a*. An electric capacitor can form between the first conductive region 23*a* and the second conductive region 24*a*. Inside the control circuit 28*a*, there is a capacitance-multiplexed switch which can be used to measure the capacitance formed between the first conductive region 23*a* and the second conductive region 24*a*.

Based on this, the cloth material that can form an electronic component 20*a* can be used as a touch switch. Because the capacitance is inversely proportional to the distance between the first conductive region 23*a* and the second conductive region 24*a*, and directly proportional to the surface area of the first conductive region 23*a* and the second conductive region 24*a*, when a user uses his finger to lightly touch the rim of the crevice 221*a* of the cloth material layer 22*a*, there will be a small change in the capacitance due to a slight change in shape and distance between the first conductive region 23*a* and the second conductive region 24*a*. During this time, the control circuit 28*a* will detect a change in capacitance and may command the output device 29*a* to emit a signal. Furthermore, the cloth material that can form an electronic component 20*a* can be designed in such a way that when a user inserts his finger in the crevice 221*a* and causes a large change in the capacitance, only then will the control circuit 28*a* command the output device 29*a* to emit a signal, thereby preventing accidental triggering. In addition, the first conductive region 23*a* and the second conductive region 24*a* can be used as an electrode. When it comes into contact with the user's skin, the cloth material 20*a* can measure the user's physiologic signs, for example, EKG, respiration, EMG, EEG, body fat, swallowing, or human surface resistance, or to provide an electric current, as in the electric current chips used in TENS (Transcutaneous Electrical Nerve Stimulation). Furthermore, there is no need for direct skin contact in order to detect ECG, heart rate and other physiologic parameters.

In addition, the designer can change a distance between the first conductive region 23*a* and the second conductive region 24*a*, surface area, material or surface texture to produce cloth materials with different capacitance. Again, since the first conductive region 23*a* and the second conductive region 24*a* are separated from the rim of the crevice 221*a* by a fixed distance, the first conductive region 23*a* and the second conductive region 24*a* will not come into contact with each other and cause a short circuit even if the crevice 221*a* closes. Because the distance of the crevice 221 changes with outside forces, so does the capacitance. Therefore, this device can be used as a position change sensor, speed sensor, and acceleration sensor.

Again, since the change in capacitance level depends on the amount of strain that is made to bear upon the cloth material layer 22*a*, hence the cloth material that can form an electronic component 20 can be used as a variable capacitor.

Figure 9:
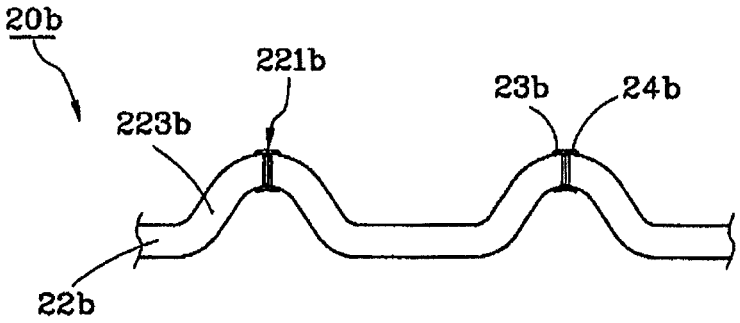
FIG. 9 shows the side view of a cloth material in accordance with a fifth embodiment of the invention.

Please refer to FIG. 9, which shows that a cloth material that can form an electronic component 20*b* provided in this invention's fifth example of preferred embodiments contains one cloth material layer 22*b*, conductive areas, several conducting wires 26*b* (not shown in drawing), one control circuit (not shown in drawing) and one output device (not shown in drawing). Among which, the conductive areas include two first conductive regions 23*b* and two second conductive regions 24*b*. Compared with this invention's third example of preferred embodiments, the only difference is, the cloth material layer 22*b* has two protrusions 223*b* that arch upwards in this illustration. The crevice 221*b* of the cloth material layer 22*b*, the first conductive area 23*b* and the second conductive area 24*b* all form on top of the protrusions 223*b*. The protrusion 223*b* also allows the user to easily insert his finger into the crevice 221*b*.

Figure 10:
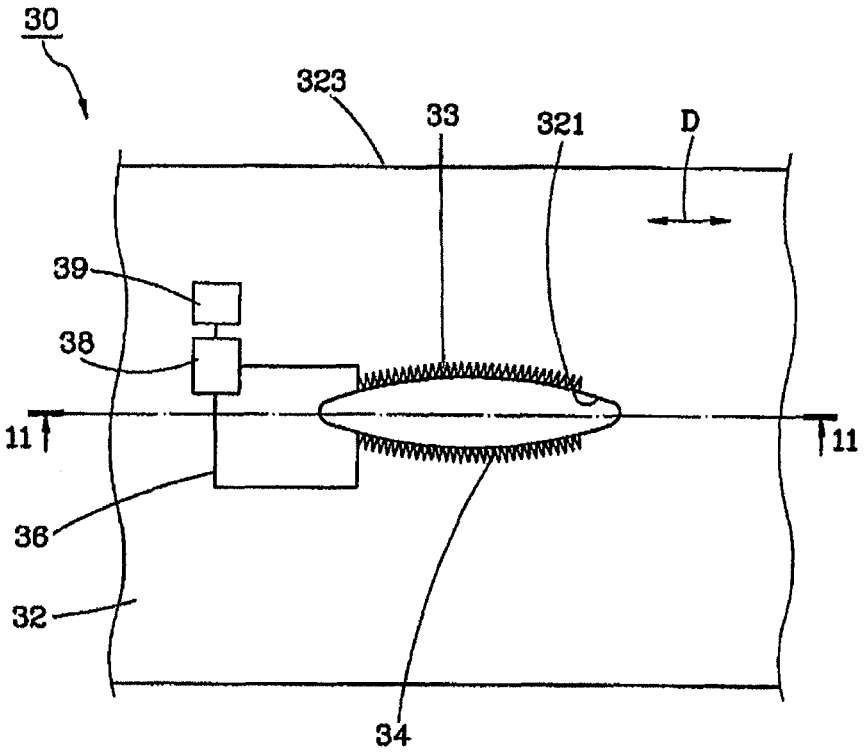
FIG. 10 shows another cloth material in accordance with a sixth embodiment of the invention.
Figure 11:
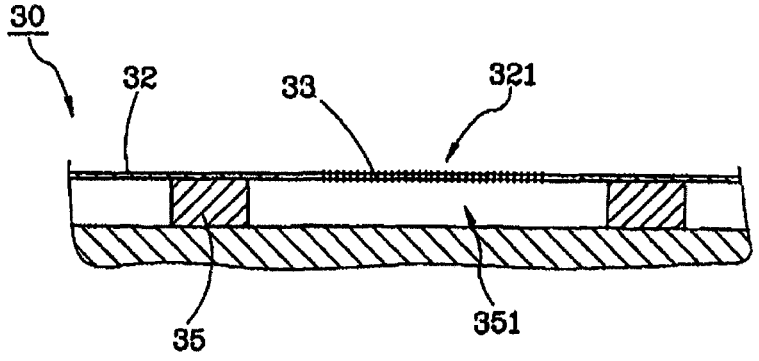
FIG. 11 shows a sectional view along the direction 11-11 of cloth material shown in FIG. 10.
Figure 12:
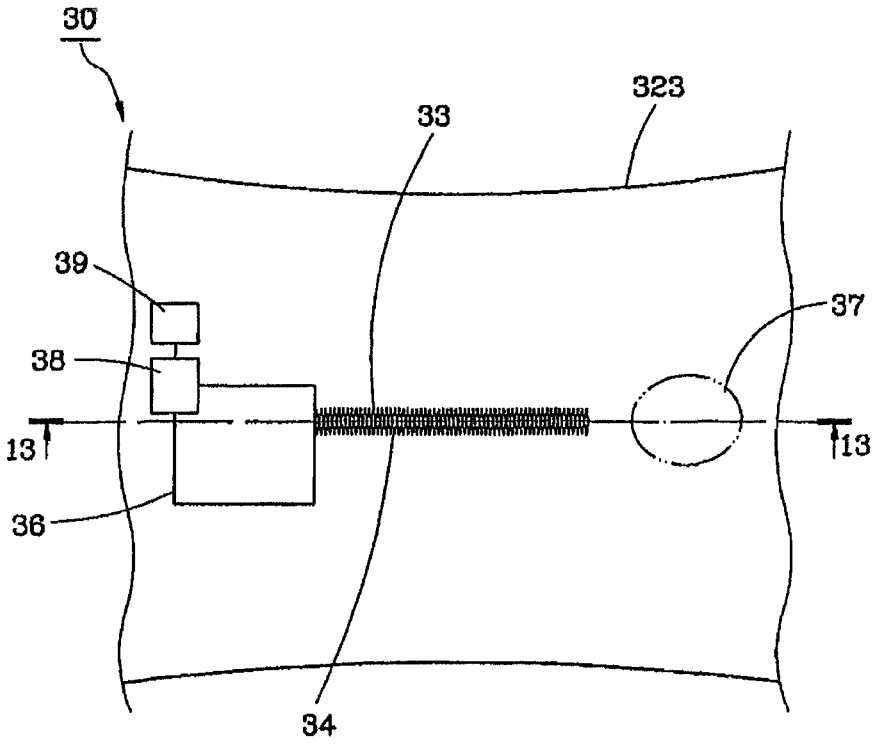
FIG. 12 shows the condition of the cloth material layer in the cloth material of FIG. 10, as it is being pressed.
Figure 13:
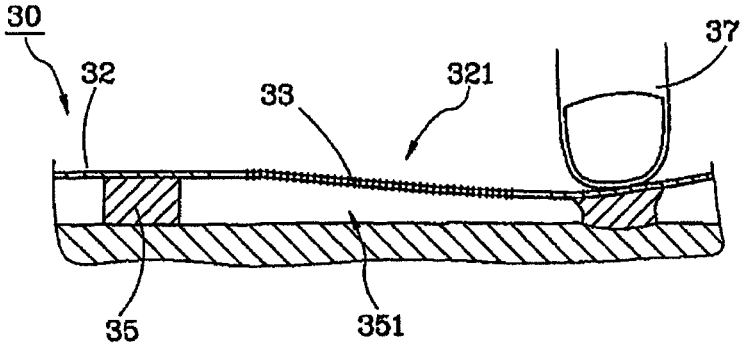
FIG. 13 shows a sectional view along the direction 13-13 of the cloth material shown in FIG. 12.

Please refer to FIG. 10 and FIG. 11, which show an illustration and a sectional view of the sixth example of preferred embodiments of the invention. A cloth material that can form an electronic component 30 provided in this example is almost the same as that provided in the previously-described third preferred example. The similarities are: both contain one cloth material layer 32, conductive areas, one cushion pad 35, two conducting wires 36, one control circuit 38 and one output device 39. The cloth material layer 32 has one crevice 321 and two outward sides 323. Among which, the conducting areas include one first conductive region 33 and one second conductive region 34. The difference is that the stretching direction of the crevice 321 is parallel to the elastic direction D of the cloth material layer 32. The cushion pad 35 is made of elastic material. Based on these, when the user's finger 37 presses on the cloth material layer 32 from one side of the crevice 321, as shown in FIGS. 12 and 13, the cushion pad 35 will change shape, and the cloth material layer 32, due to being strained, will cause the two outward sides 323 to move in the direction of the nearby crevice 321. The capacitance produced by the first conductive region 33 and the second conductive region 34 will decrease as the distance between them shortens. Based on this, the control circuit 38 will detect the change in capacitance value and may command the output device 39 to emit a sound.

Figure 14:
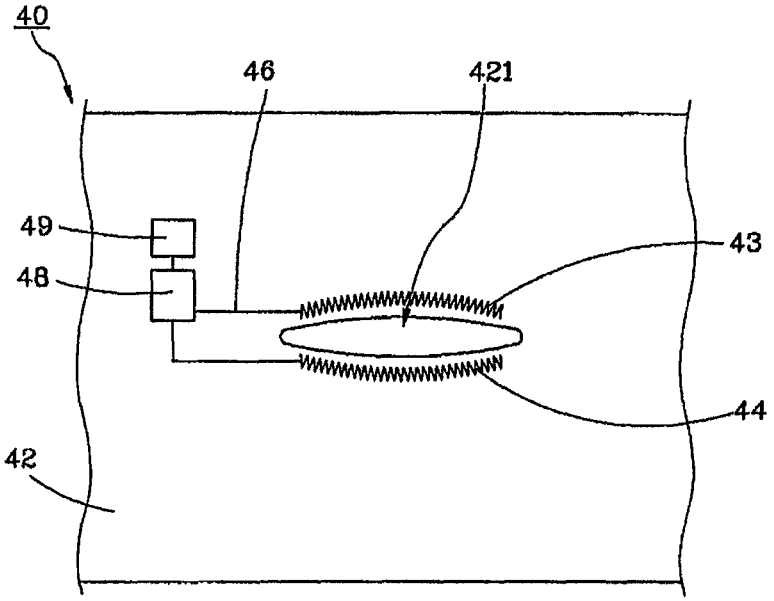
FIG. 14 shows another cloth material in accordance with a seventh embodiment of the invention.

Please refer to FIG. 14, which is a plane view of the seventh preferred example of embodiments of the invention. The cloth material that can form an electronic component 40 provided in this seventh preferred example is almost the same as that provided in the previous example. The only difference is, that the first conductive region 43 and the second conductive region 44 are located on both sides of the crevice 421 of the cloth material layer 42, and is separated by a fixed distance from the rim of the crevice 421. An electric capacitance can form between the first conductive region 43 and the second conductive region 44. Inside the control circuit there is a capacitance meter which can be used to measure the capacitance produced in these first conductive region 43 and these second conductive region 44.

Figure 15:
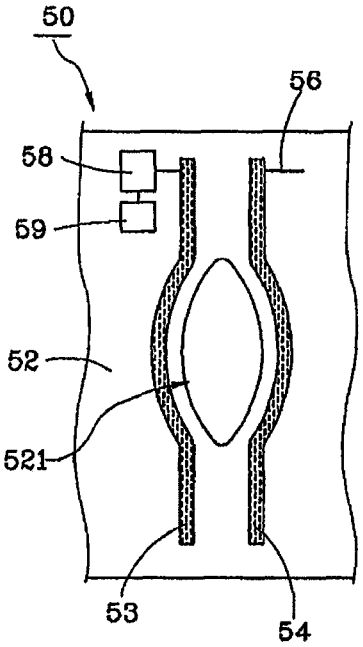
FIG. 15 shows another cloth material in accordance with an eighth embodiment of the invention.

Please refer to FIG. 15, which is a plane view of the eighth preferred example of embodiments of the invention. The cloth material that can form an electronic component 50 provided in this eighth preferred example is almost the same as that provided in the previous example. The only difference is that the length of the first conductive region 53 and the second conductive region 54 is longer than that of the crevice 521 of the cloth material layer 52. This elongated first conductive region 53 and the second conductive region 54 will render the cloth material that can form an electronic component 50 in such a way that when outside force is applied, it will better reflect the change in capacitance.

Figure 16:
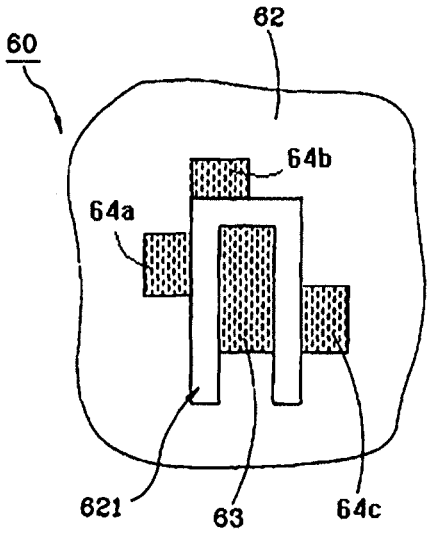
FIG. 16 shows another cloth material in accordance with a ninth embodiment of the invention.

Please refer to FIG. 16, which is a plane view of the ninth preferred example of embodiments of the invention. The cloth material that can form an electronic component 60 provided in this ninth preferred example is almost the same as that provided in the previous example. The only difference is, the crevice 621 of the cloth material layer 62 is U-shaped, and the first conductive region 63 and the second conductive regions 64*a*, 64*b*, 64*c* of the conductive area each forms on the inner and outer sides of the crevice 62, respectively.

Figure 17:
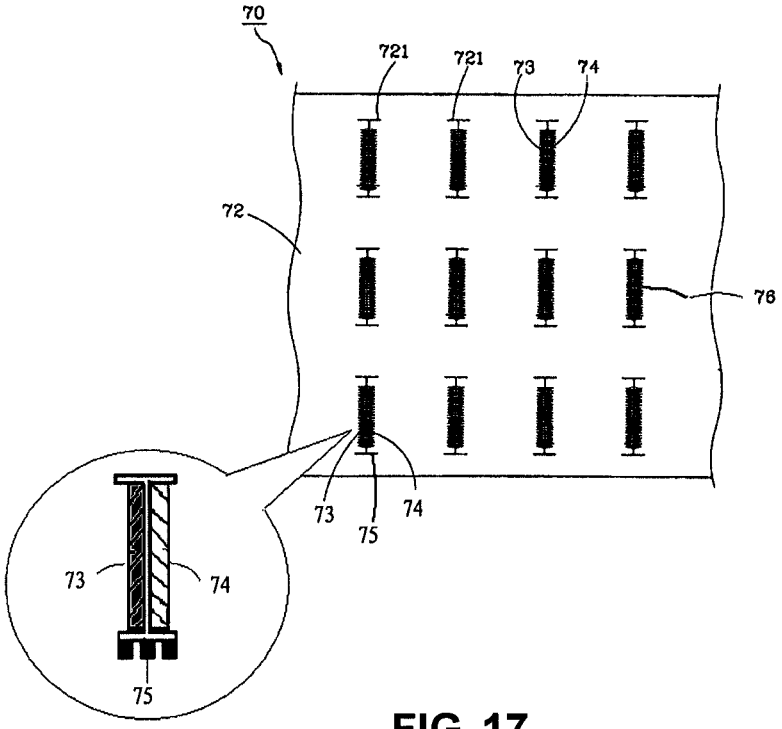
FIG. 17 shows another cloth material in accordance with a tenth embodiment of the invention.

Please refer to FIG. 17, which is a plane view of the tenth preferred example of embodiments of the invention. The cloth material that can form an electronic component 70 provided in this tenth preferred example is almost the same as that provided in the previous example. It contains one cloth material layer 72, several conductive areas, which include several first conductive regions 73, several second conductive regions 74, several third conductive regions 75, several conducting wires 76, one control circuit (not shown in drawing) and one output device (not shown in drawing). The cloth material layer 72 has several crevices 721 arranged in a matrix. The crevices 721 are each H-shaped. The first conductive regions 73 are paired with the second conductive regions 74 and both are arranged on the inner sides of the H-shaped crevices 721. The third conductive regions are located on the outer sides of the H-shape. A control circuit is electrically connected to the first conductive regions 73, the second conductive regions 74 and the third conductive regions 75 via the conducting wires 76. Therefore, the cloth material that can form an electric component 70 can be used as a switch matrix or a keyboard. At the same time, we will know the direction of the force applied by the user. For example, if there is a reaction produced between the first conductive regions 73 and the third conductive regions 75, then the direction of the force applied is towards the left as shown in this illustration. If there is a reaction produced between the second conductive regions 74 and the third conductive regions 75, then the direction of the force applied is towards the right. The H-shaped crevices 721 can be easily opened by the user.

Figure 18:
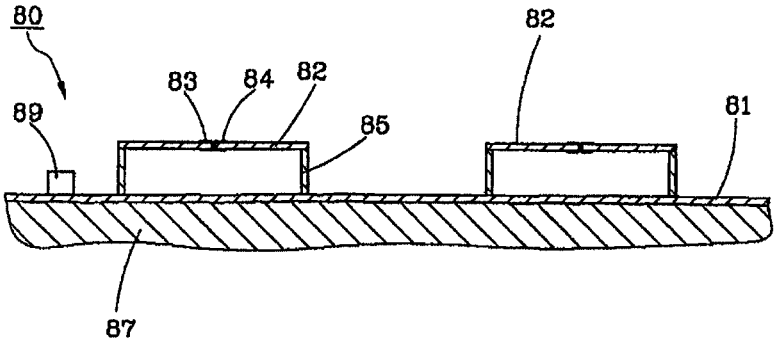
FIG. 18 shows a sectional view of a cloth material in accordance with a eleventh embodiment of the invention.

Please refer to FIG. 18, which is a plane view of the eleventh preferred example of embodiments of the invention. The cloth material that can form an electronic component 80 provided in this eleventh preferred example is almost the same as that provided in the previous example. The only difference is that it also includes a base cloth material 81, where the cushion pad 85 and the control circuit 89 are fixed. The cushion pad 85 is made of a conductive material, while the base cloth material 81 includes a conductive material, allowing the first conductive region 83 and the second conductive region 84 to be electrically connected to the control circuit 89 via the cushion pad 85 and the base cloth material 81. The base cloth material 81 may contact a user's skin 87.

Figure 19:
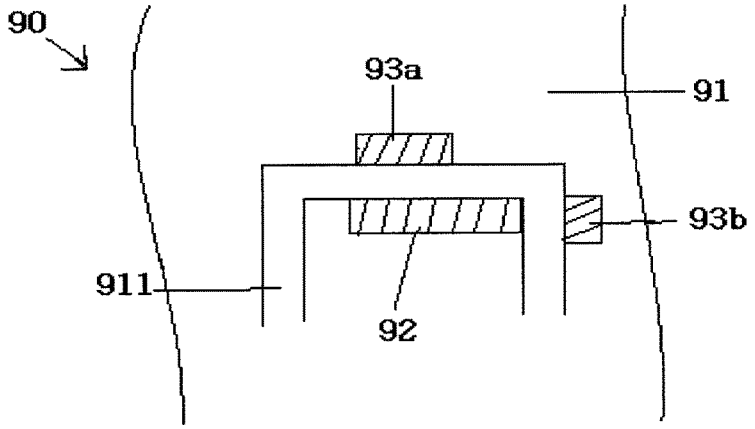
FIG. 19 shows another cloth material in accordance with a twelfth embodiment of the invention.

Please refer to FIG. 19, which is a plane view of the twelfth preferred example of embodiments of the invention. The cloth material that can form an electronic component 90 provided in this twelfth preferred example is almost the same as that provided in the ninth preferred example. The only difference is that the crevice 97 of the cloth material layer 91 is U-shaped and the second conductive region is evenly divided into two. Its first conductive region 92 and the second conductive regions 93*a*, 93*b* each forms on different locations around the crevice 91, respectively. Without an outside force, the first conductive region 92 and the second conductive area 93*a* region may contact each other. With a change in the outside force, such as pulling and dragging, conductive regions 92 and 93*b* may be brought into contact. This may be used to discern changes in outside forces.

Figure 20:
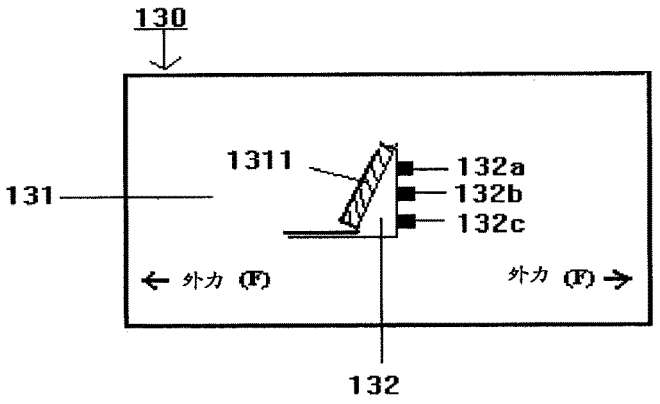
FIG. 20 shows a cloth material in accordance with a thirteen embodiment of the invention.

Please refer to FIG. 20, which is a plane surface view of the thirteenth preferred example of the embodiments of the invention. The cloth material that can form an electronic component 130 provided in this invention's thirteenth preferred example is almost the same as that provided in the third example. The only difference is that the crevice 132 of the cloth material layer 131 is L-shaped. The conductive area includes a first conductive region 1311 and second conductive regions 132*a*, 132*b* and 132*c*, each forming on the rim of the two sides of the crevice 132. Therefore, without an outside force, the first conductive region 1311 and the second conductive regions 132*a*, 132*b* and 132*c* are in contact with each other. When an outside force continually increases, the first conductive region 1311 will be separated first from the second conductive region 132*c*, then from 132*b*, and lastly from 132*a*. Similarly, as shown in FIG. 20, if the outside force gradually decreases, the first conductive region 1311 will come into contact first with the second conductive region 132*a*, then with 132*b*, and lastly with 132*c*.

Figure 21:
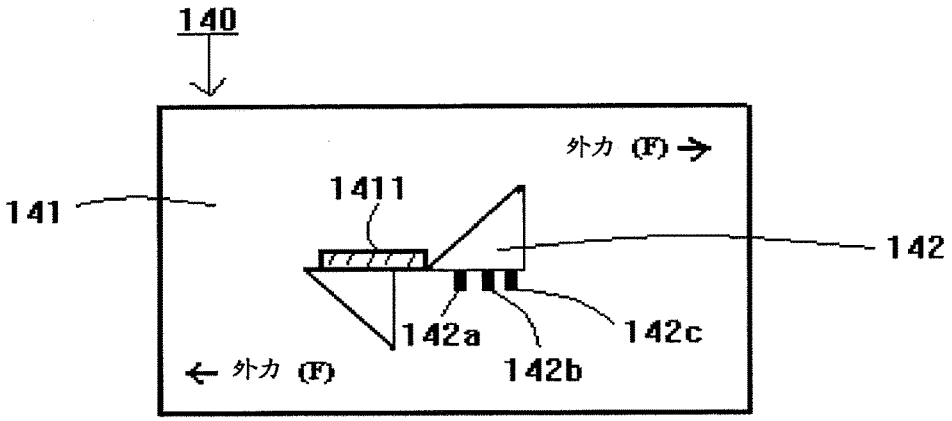
FIG. 21 shows a cloth material in accordance with a fourteen embodiment of the invention.

Please refer to FIG. 21, which is a plane view of the fourteenth preferred example of embodiments of the invention. The cloth material that can form an electronic component 140 provided in this fourteenth example is almost the same as that provided in the thirteenth example. The only difference is that the crevice 142 of the cloth material layer 141 is ㄣ -shaped. The first conductive region 1411 and the second conductive regions 142*a*, 142*b* and 142*c*, each forms on the rim of the two sides of the crevice 142. Thus, without an outside force, the first conductive region 1411 and the second conductive regions 142*a*, 142*b* and 142*c*, are in contact with each other. When an outside continually increases, the first conductive region 1411 will first separate from the second conductive region 142*c*, then from 142*b*, and lastly from 142*a*. As shown in FIG. 21, as the outside force gradually decreases, the first conductive region 1411 will first come into contact with the second conductive region 142*a*, followed by 142*b*, and lastly with 142*c*.

Figure 22:
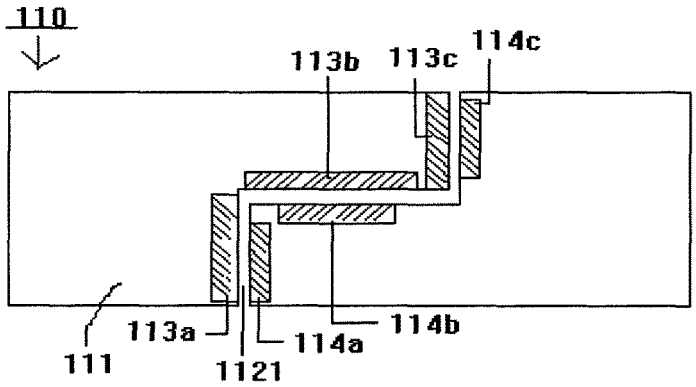
FIG. 22 shows a partial view of a cloth material in accordance with a fifteenth embodiment of the invention.

Please refer to FIG. 22, which is a plane view of the fifteenth preferred example of embodiments of the invention. The cloth material that can form an electronic component 110 provided in this fifteenth example is almost the same as that provided in the third example. The only difference is that the cloth material 111 has two layers stack (or overlap) on the two sides of the crevice 1121. The conductive area includes the first conductive region and the second conductive region. The first conductive region and the second conductive region are stacked. The first conductive regions 113*a*, 113*b*, 113*c* and the second conductive regions 114*a*, 114*b*, 114*c* respectively forms on the both sides of the crevice 1121. Without an outside force, the first conductive regions 113*a*, 113*b*, 113*c* and the second conductive regions 114*a*, 114*b*, 114*c* are in contact with each other. With a change in an outside force, such as pulling and dragging, the contact between the first conductive regions 113*a*, 113*b*, 113*c* and the second conductive regions 114*a*, 114*b*, 114*c* will change. This can be used to differentiate changes in outside forces.

Figure 23:
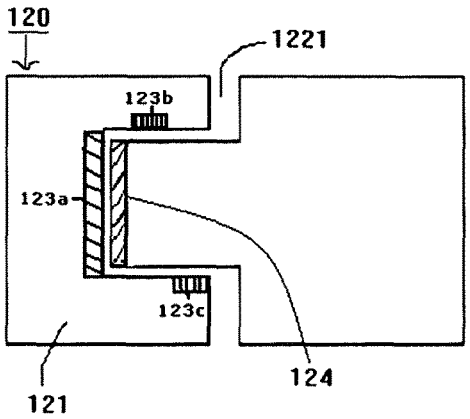
FIG. 23 shows a partial view of a cloth material in accordance with a sixteenth embodiment of the invention.

Please refer to FIG. 23, which is a plane view of the sixteenth preferred example of embodiments of the invention. The cloth material that can form an electronic component 120 provided in this sixteenth example is almost the same as that provided in the third example. The only difference is that the crevice 1221 of the cloth material layer 121 is located within the cloth material layer 121, and is n-shaped. The first conductive regions 123*a*, 123*b*, 123*c* and the second conductive region 124 each are formed on both sides of the crevice 1221. Without an outside force, the first conductive regions 123*a*, 123*b*, 123*c* and the second conductive region 124 are in contact with each other. The second conductive area 124 is located in a protruding piece of cloth which fits in a fillister of the cloth material layer where the first conductive regions 123*a*, 123*b*, 123*c* are located. With a change in outside force, such as pulling and dragging, the conductivity between the first conductive area 123*a*, 123*b*, 123*c* and the second conductive area 124 will change. This may be used to differentiate the changes in outside forces.

Figure 24:
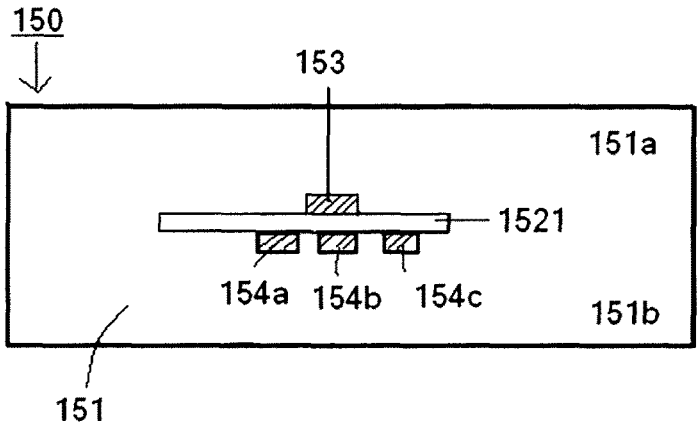
FIG. 24 shows a partial view of a cloth material in accordance with a seventeenth embodiment of the invention.

Please refer to FIG. 24, which is a plane view of the seventeenth preferred example of embodiments of the invention. The cloth material that can form an electronic component 150 provided in this seventeenth example is almost the same as that provided in the third example. The only difference is that the crevice 1521 of the cloth material layer 151 is located within the cloth material layer itself. The elastic coefficient of the cloth material layer 151*a* in the upper layer of the crevice may be different from that of the cloth material layer 151*b* in the lower layer of the crevice. The upper layer 151*a* and the lower layer 151*b* of the cloth material stack on top of each other. The first conductive region and the second conductive region are located on the top and bottom sides of the crevice 1521. The first conductive region 153 and the second conductive regions 154*a*, 154*b*, 154*c* are formed on the top and bottom sides of the crevice 1521. Without an outside force, the first conductive region 153 and the second conductive regions 154*a*, 154*b*, 154*c* are in contact with each other. With a change in an outside force, such as pulling and dragging, the conductivity between the first conductive region 153 and the second conductive regions 154*a*, 154*b*, 154*c* will change, which may be used to discern changes in outside forces, for example, the magnitudes and the directions of the applied forces.

The above description is only about preferred examples of embodiments of the invention, and is not intended to limit the scope of the invention in any form. Even though this invention is described using several preferred examples mentioned above, these examples are not to be used to limit the scope of this invention. Any person familiar with the art can make modifications or variations that are equivalents based on the above examples, without departing from the scope of the invention. Any embodiments that do not depart from the scope of the invention, and are based on the technical essence of this invention, having simple modification, equivalent variations or modifications, are still included in the scope of the invention.

What is claimed is:

1. A cloth material that can form an electronic component, comprising:

a single-layer cloth material, which includes at least one crevice; and a conductive area included in the single-layer cloth material, wherein the conductive area comprises a first conductive region on one side of the crevice and a second conductive region on the other side of the crevice, wherein a gap of the crevice increases with an outside force applied in a direction in the plane of the single-layer cloth material to change an electric property of the conductive area, wherein the at least one crevice is disposed on a surface of the single-layer cloth material, and wherein the crevice forms an opening on the single-layer cloth material when the outside force is applied.

2. The cloth material that can form an electronic component as described in claim 1, wherein the first conductive region the second conductive region are formed as a continuous region.

3. The cloth material that can form an electronic component as described in claim 2, wherein the first conductive region is located proximate a rim of the crevice.

4. The cloth material that can form an electronic component as described in claim 3, wherein the first conductive region is located at a predetermined distance from a rim of the crevice.

5. The cloth material that can form an electronic component as described in claim 1, wherein the first conductive region and the second conductive region are not directly connected with each other and the electric property that is changed by the outside force is a capacitance or resistance.

6. The cloth material that can form an electronic component as described in claim 5, wherein the first conductive region or the second conductive region is separated from a rim of the crevice by a predetermined distance.

7. The cloth material that can form an electronic component as described in claim 5, wherein the crevice of the single-layer cloth material is an H-shaped crevice; the at least one first conductive region and the at least one second conductive region are separately located on two inner regions defined by the H-shaped crevice.

8. The cloth material that can form an electronic component as described in claim 1, characterized in that the single-layer cloth material further comprises a cushion pad disposed on one side of the single-layer cloth material.

9. The cloth material that can form an electronic component as described in claim 1, wherein the single-layer cloth material further comprises a control circuit that is electrically connected to the conductive area.

10. The cloth material that can form an electronic component as described in claim 9, wherein the control circuit includes either a resistance-multiplexed switch or a capacitance-multiplexed switch.

11. The cloth material that can form an electronic component as described in claim 9, wherein the single-layer cloth material further comprises at least one conductive reference area on the single-layer cloth material and electrically connected to the control circuit.

12. The cloth material that can form an electronic component as described in claim 11, wherein the at least one described reference area comprises two or more reference areas, wherein the control circuit determines whether there is electrical leakage based on the presence or absence of a circuit formed among the two or more reference areas.

13. The cloth material that can form an electronic component as described in claim 11, wherein the control circuit determines whether there is electrical leakage based on the presence or absence of a circuit formed between the reference area and the conductive area.

14. The cloth material that can form an electronic component as described in claim 1, wherein materials of the single-layer cloth material on both sides of the crevice are different.

15. The cloth material as described in claim 1, wherein the single-layer cloth material is used as an electrical component, and wherein the electronic component is any one of the following: a moisture sensor, a switch, a pressure gauge, a strain gauge, a signal-producing device, a posture-change sensor, a position-change sensor, a gait-analyzing sensor, a falling down sensor, a respiration sensor, a swallowing sensor, a speedometer sensor, or an acceleration sensor.

16. The cloth material according to claim 1, wherein the conductive area is used as an electrode.

17. The cloth material as described in claim 11, wherein the reference area is used as an electrode.

18. The cloth material of claim 1, wherein the crevice remains in a closed position when not experiencing outside force.

* * * * *